US005090928A

United States Patent [19]

Rybczyk

[11] Patent Number: 5,090,928

[45] Date of Patent: Feb. 25, 1992

[54] MAN-POWERED PROPULSION DEVICE

[76] Inventor: Joseph A. Rybczyk, 365 Newtown Rd., D-16, Warminster, Pa. 18974

[21] Appl. No.: 365,108

[22] PCT Filed: Sep. 22, 1986

[86] PCT No.: PCT/US86/02004

§ 371 Date: Mar. 20, 1989

§ 102(e) Date: Mar. 20, 1989

[87] PCT Pub. No.: WO88/01966

PCT Pub. Date: Mar. 24, 1988

[51] Int. Cl.[5] ..... B63H 16/08

[52] U.S. Cl. ..... 440/24; 416/140

[58] Field of Search ..... 440/21, 24–32; 416/140

[56] References Cited

U.S. PATENT DOCUMENTS

| | | | |
|---|---|---|---|
| 954,718 | 4/1910 | Cutler | 440/30 |
| 2,158,349 | 5/1939 | Allen | 440/24 |
| 2,198,904 | 4/1940 | Christiansen | 440/24 |
| 2,633,096 | 3/1953 | Rayfield | 440/24 |
| 3,349,746 | 10/1967 | Sydoriak | 440/24 |

FOREIGN PATENT DOCUMENTS

| | | | |
|---|---|---|---|
| 1554862 | 1/1969 | France | 440/24 |
| 1032 | of 1882 | United Kingdom | 440/24 |
| 374287 | 6/1932 | United Kingdom | 440/25 |

*Primary Examiner*—Jesus D. Sotelo

*Attorney, Agent, or Firm*—Dann, Dorfman, Herrell and Skillman

[57] ABSTRACT

A lightweight propulsion device for use with various types of lightweight boats and other small craft, including use with a swimmer is provided with a frame for mounting the propulsion device on the craft. A shaft rotatably supported on the frame carries a propeller, including flexible blades rotatably supported relative to the shaft on a hub. The blades are supported for rotation about an axis having a major radial component and stop means supported relative to the shaft limits movement of each blade in each direction from a plane through the shaft axis. A pair of cables are coupled to the shaft to turn the shaft and are positioned to be wrapped around the shaft in opposite directions. Sheaves on the shaft for each cable contain and direct the cables as they are alternately wrapped and unwrapped around the shaft. The cables are attached to a man powering the propulsion device by means affixed to the cables which allow alternate cables to be pulled so as to unwrap the cable which is wrapped around the shaft and so that, as the cable which is wrapped around the shaft is unwrapped, the other cable is, in turn, wrapped around the shaft. The alternate pull on the cables thereby imparts an oscillatory motion to the shaft. Orientation of the shaft and propeller is normally horizontal in the water, but, depending upon the nature of the craft and the complexity of operation, the frame may be more or less complex or simple.

56 Claims, 11 Drawing Sheets

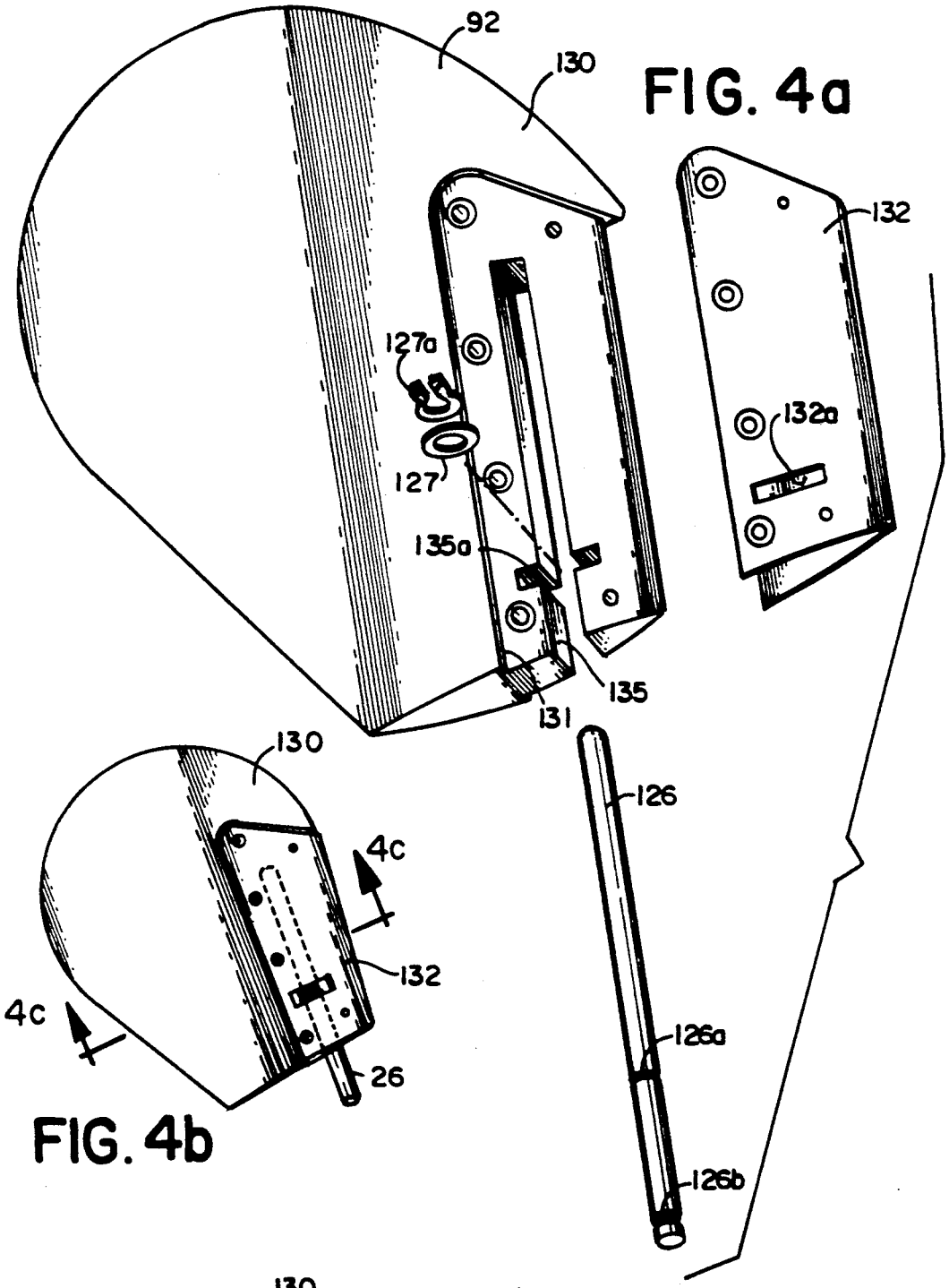
FIG. 4a
FIG. 4b
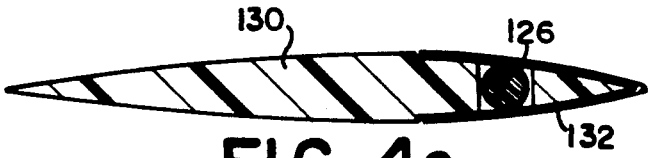
FIG. 4c 222
296b
248a
296a
248b
274b
274a
272
290
234
224
234
248
290
250

296b
222
262
248a
296a
248b
229
244
246
264
266
228
240
242
266
261
265
244
272
290
298a
252
254
234
250
224
298b
248
26
234
294
290
250

MAN-POWERED PROPULSION DEVICE

The present invention relates to a propulsion device which is powered by the movement of the arms or the legs of a human being. The propulsion device assumes many forms for attachment to different kinds of craft and can even be directly attached to the person supplying the operating power. In each case, however, the invention relates to a propeller device including a blade or blades which are movable to accommodate to the reciprocating motion of the shaft supporting the propeller. The invention is also directed to the craft to which a propulsion device may be attached in the sense that the craft is modified for use with such a device.

BACKGROUND OF THE INVENTION

Man-powered craft are available for hire in waterfront recreation areas and commonly are propelled by continuously rotating paddle wheels operated by various kinds of foot pedal devices. Commonly such craft are pontoon based with seats that allow the user to sit high above the water. In general, they are noted for a ponderous movement and relatively limited speed capabilities.

More recent developments have included fiberglass boats of various types with transmission devices allowing reciprocating motion to be transformed into rotational motion by some conventional means. By improving the hydrodynamic contour of the craft, greater speed may be achieved, but, to date, the limitations on speed have been such that boats that are paddled or rowed are ordinarily faster and more efficient than any such craft.

THE NATURE OF THE PRESENT INVENTION

The present invention is concerned with a man-powered propulsion device which employs cables connected to pedals or other means permitting the man operator to produce reciprocating motion. The reciprocating motion is, in turn, transmitted to a shaft around which the cables are alternately wound in opposite directions onto separate sheave means. Flexible propeller blades are attached to the propeller shaft by means generally radially oriented with respect to that shaft and about which means each blade is permitted to rotate. Rotation, however, is confined to a very limited arc by stops supported relative to the shaft. The stops limit each blade to a predetermined limited amount of movement by pure rotation of the blade, then as each blade flexes, the stop allows blade sliding relative to the stop to define a final blade position and shape during the rest of the rotation in a particular direction. The yielding of the flexible material permits each blade to assume the advantageous curvature of a propeller screw by sliding along the stop means. Since the blade is flexible, the curvature occurs in the opposite direction when propeller rotation direction is reversed.

Two bladed propellers on propulsion devices affixed to the respective cable means of the propulsion device have been constructed and operated highly efficiently. BY fabricating a boat of lightweight materials with good hydrodynamic flow lines, it is possible for the boat to pass most conventionally operated hand propelled craft and maintain a competitive speed with boats propelled by light trolling motors. The device itself can be very lightly constructed and if the boat and propulsion device are both lightweight, they can be easily transported by passenger car and launched without difficulty in most bodies of water without special provision for launching of any sort.

More specifically, the present invention is directed to a man-powered propulsion device having a frame including means to mount to a boat or other craft, including direct mounting to the body of a swimmer, to manually propel the craft which, as used herein, may be interpreted to include a swimmer. It will be understood that "manually" includes foot power. Propeller means is provided on a shaft means rotatably supported on the frame and includes at least one flexible blade rotatably supported generally radially relative to the shaft and stop means supported on the shaft limiting movement of each blade. A pair of actuator means are coupled to the shaft to turn the propeller shaft, each of which is arranged to drive the propeller shaft in the opposite direction from the other means. Each actuator means is actuated by manpower at alternating times thereby to impart an oscillating motion to the propeller.

In preferred embodiments actuator means is provided by sheave means on the shaft means for each of a pair of cable means so that the sheave means contains and directs the cable means as they are wrapped around the shaft means to move the propeller in opposite directions. Means attached to the cable means pulls alternately on that cable wrapped onto its sheave and around the shaft so that, as that cable is unwrapped, the other is wrapped onto the other sheave and around the shaft.

There are various modifications of the propulsion device involving additional structure which will appear from the specific description.

For a better understanding of the present invention, reference is made to the accompanying drawings in which.

Figure 1:
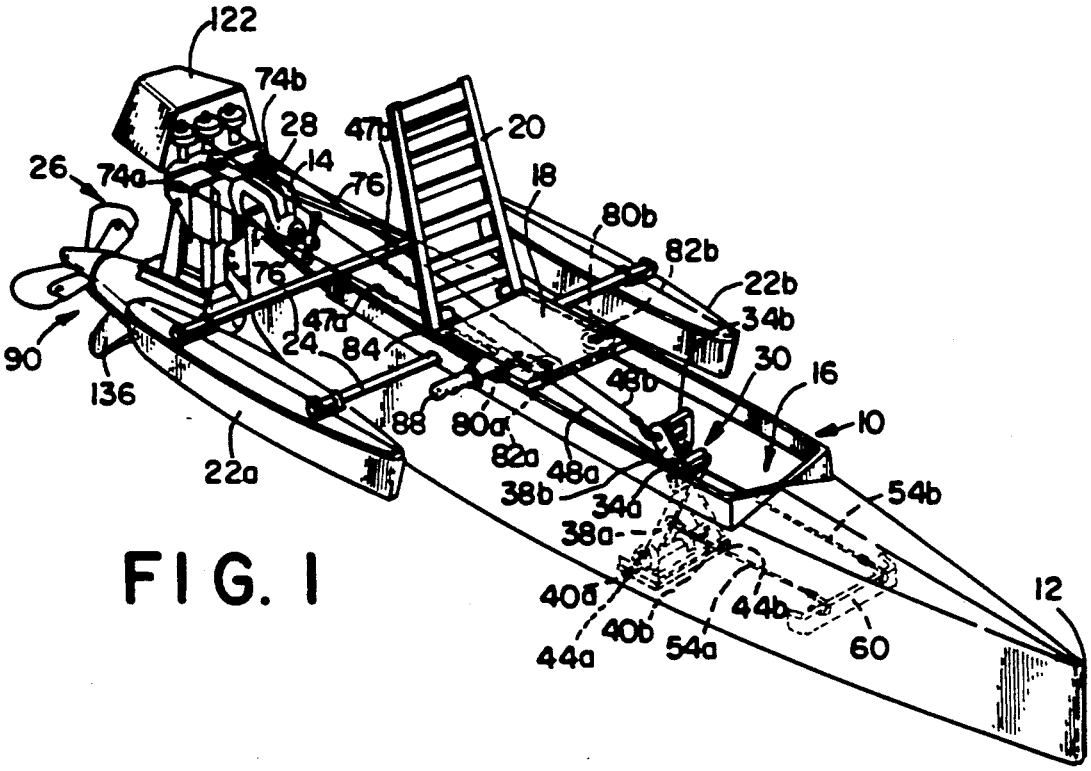
FIG. 1 shows in perspective a boat having attached to it a propulsion device of the present invention.
Figures 3, 3A:
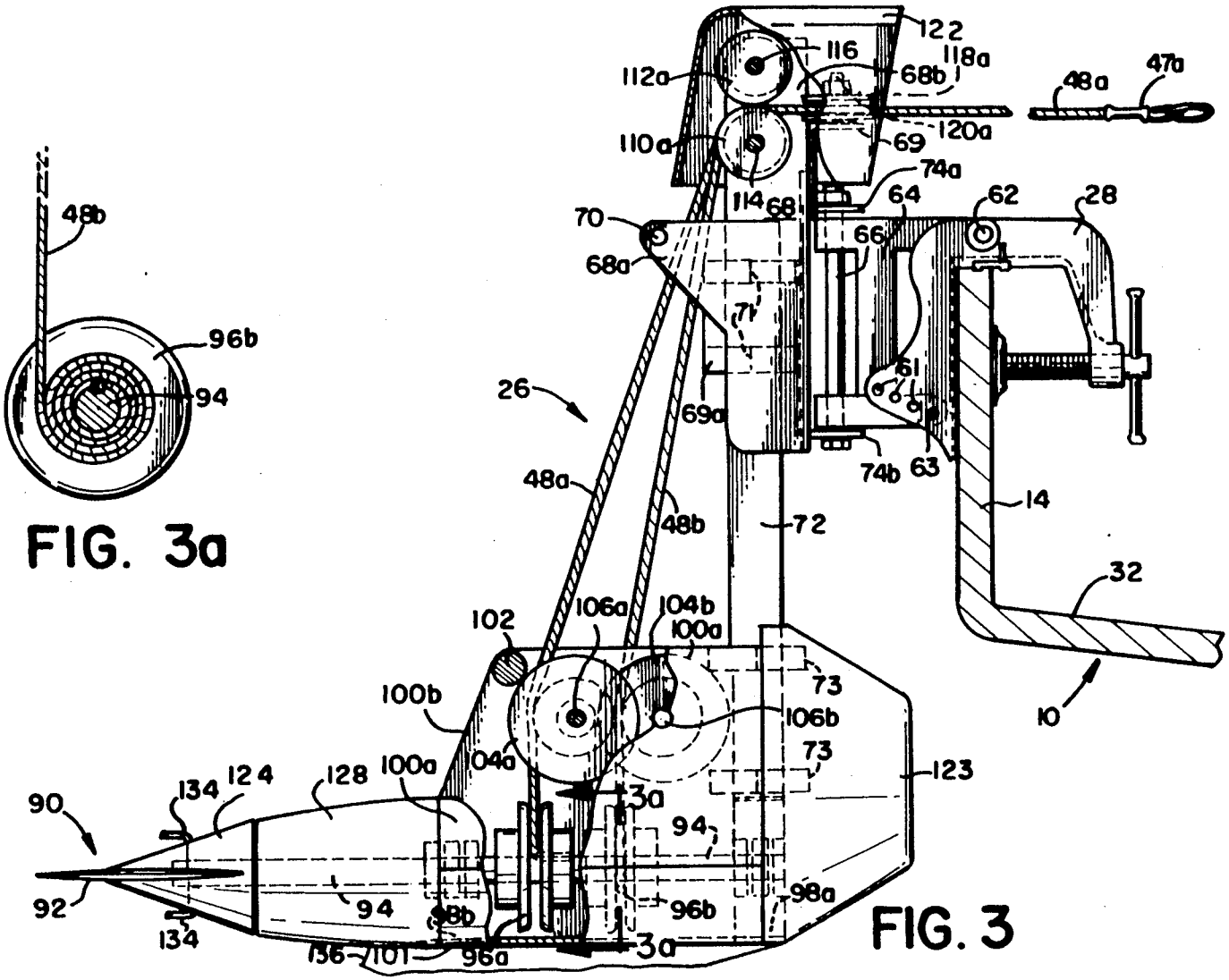
FIG. 3 is a side elevational view partially in section and still further enlarged of the propulsion device attached to the boat.
Figure 4:
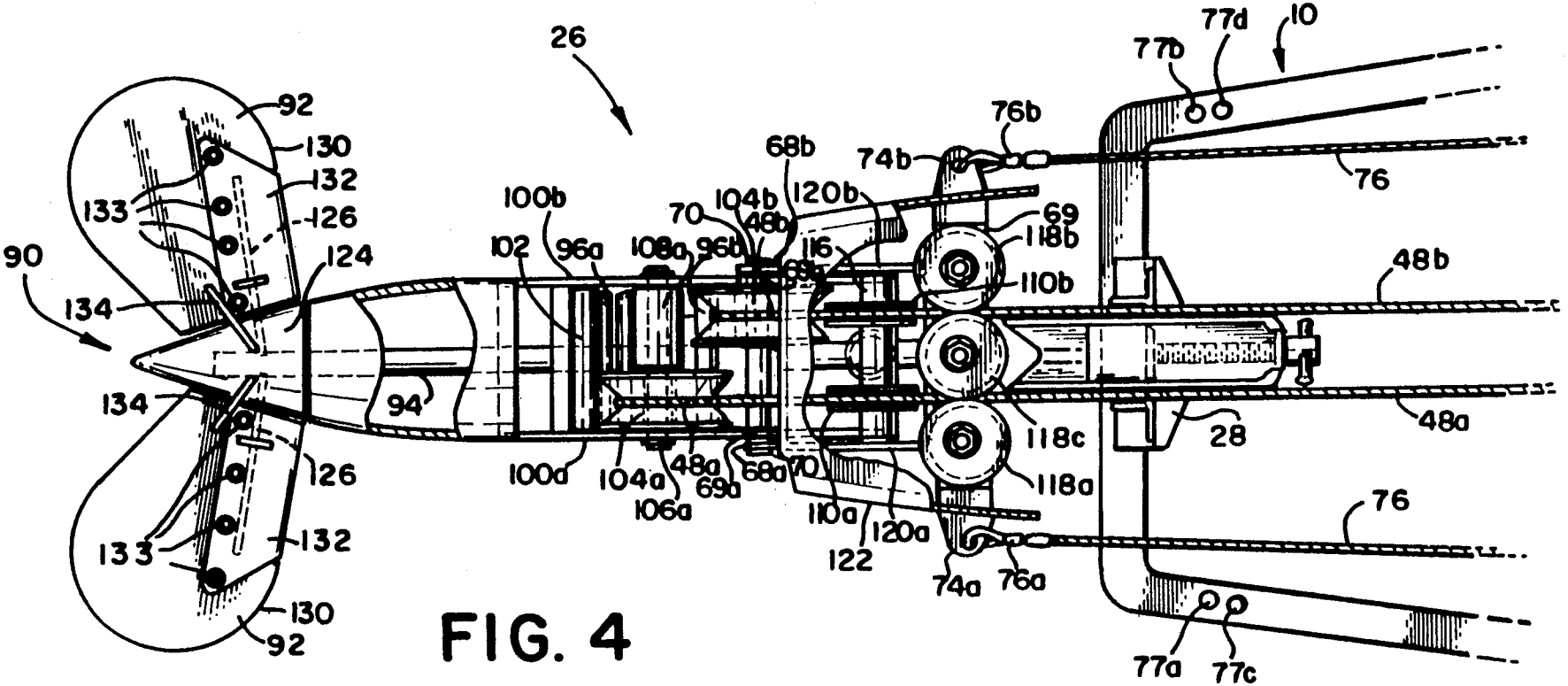
Figure 5:
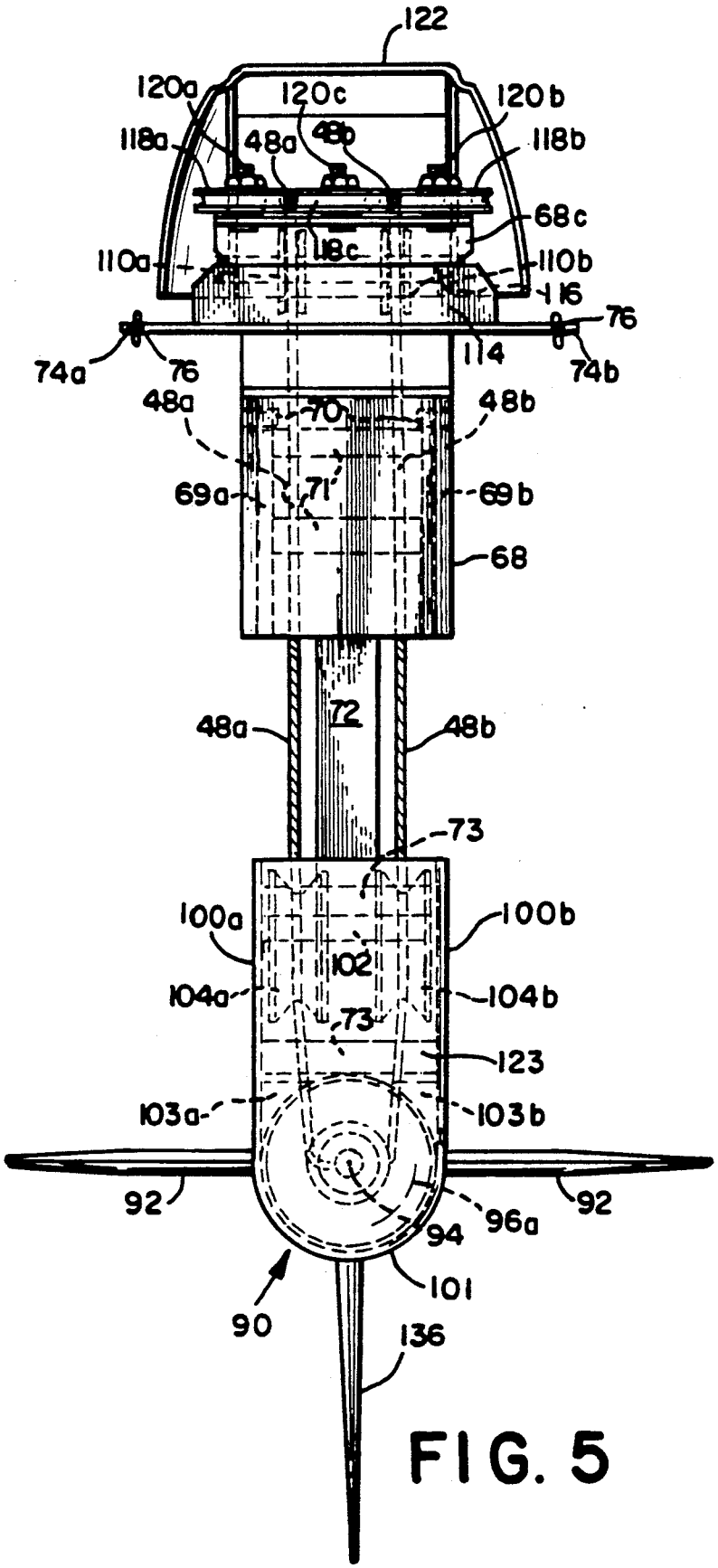
Figure 6:
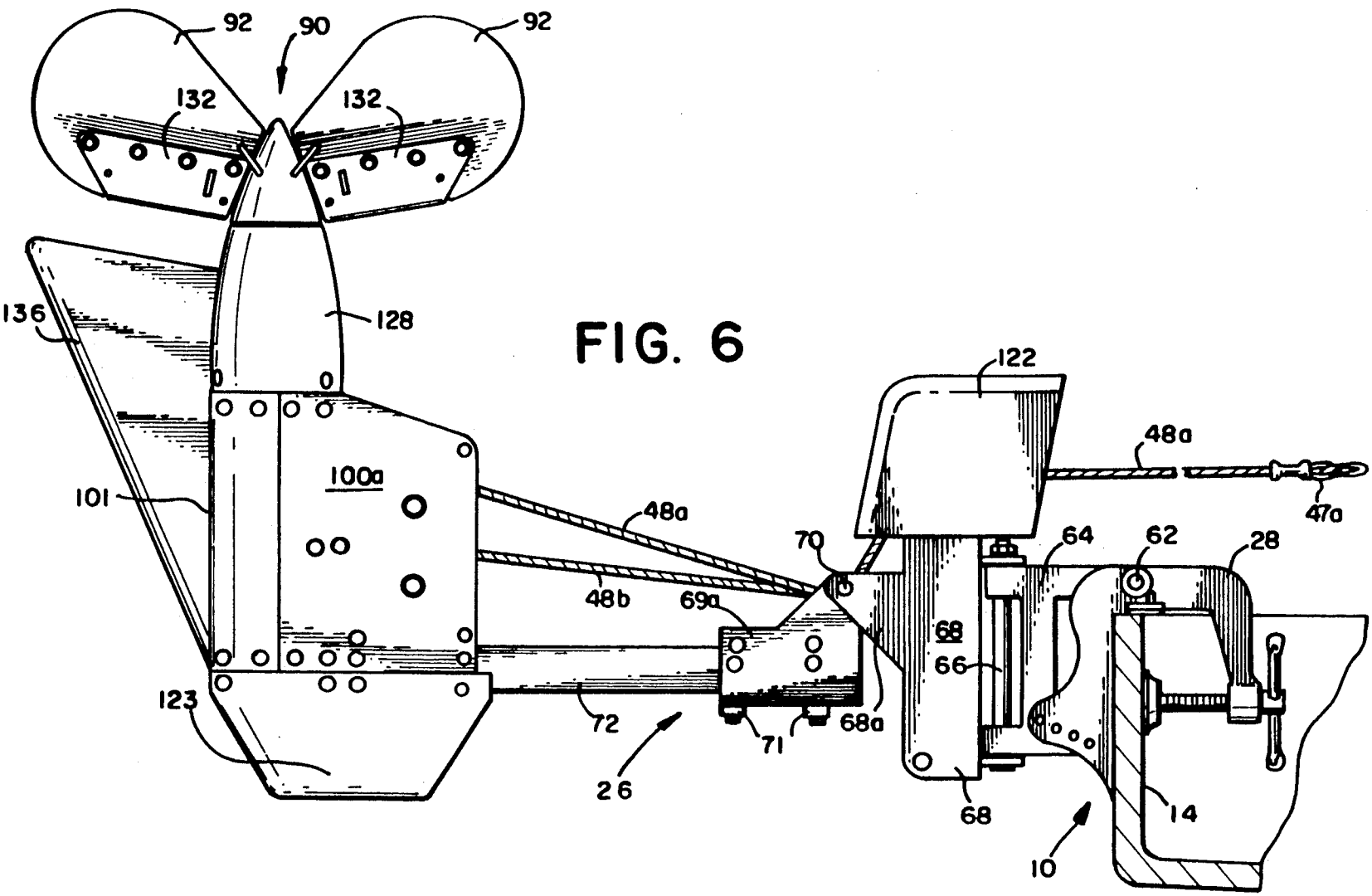
Figure 7:
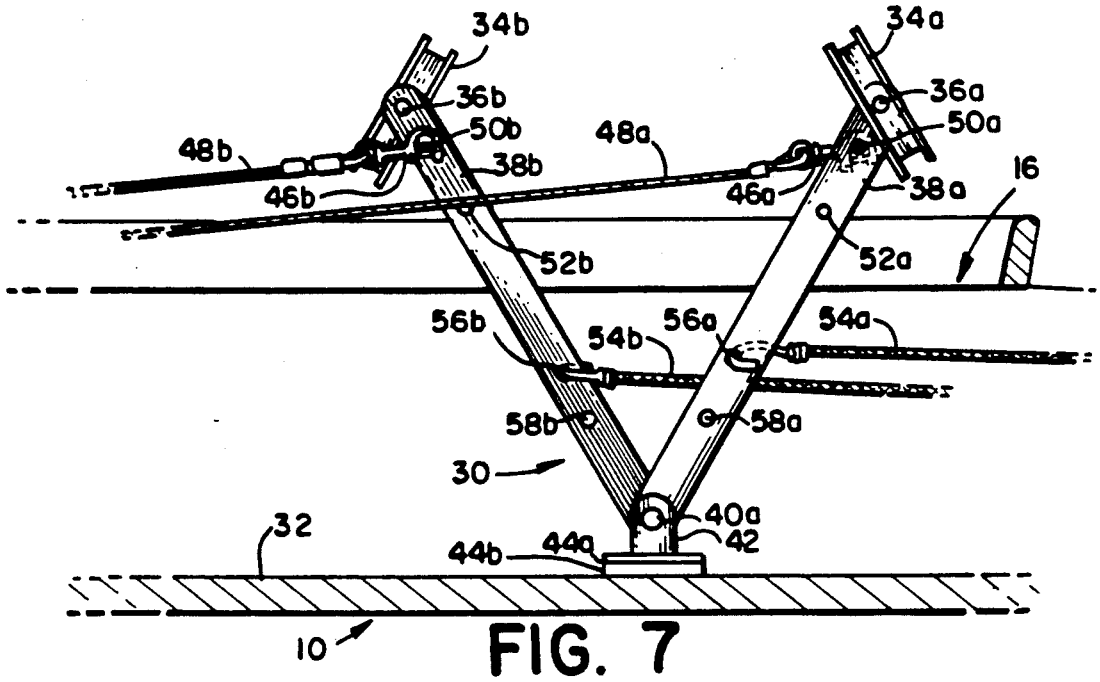
Figure 8:
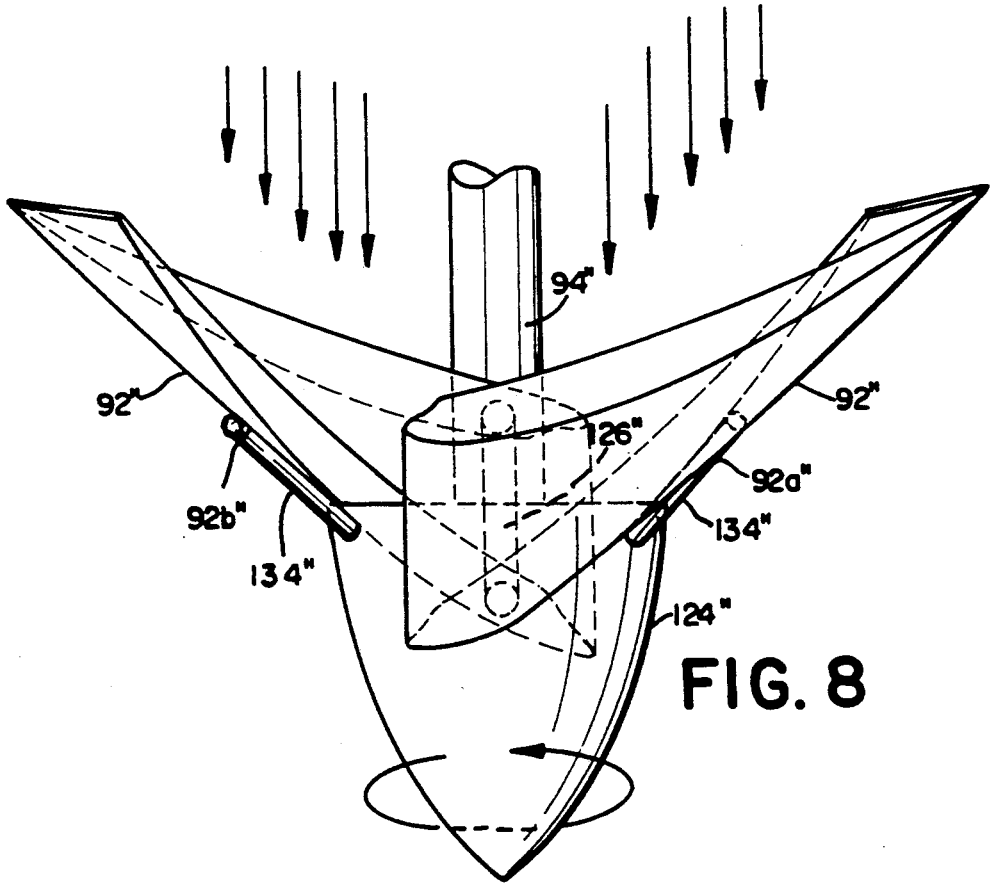
Figure 9:
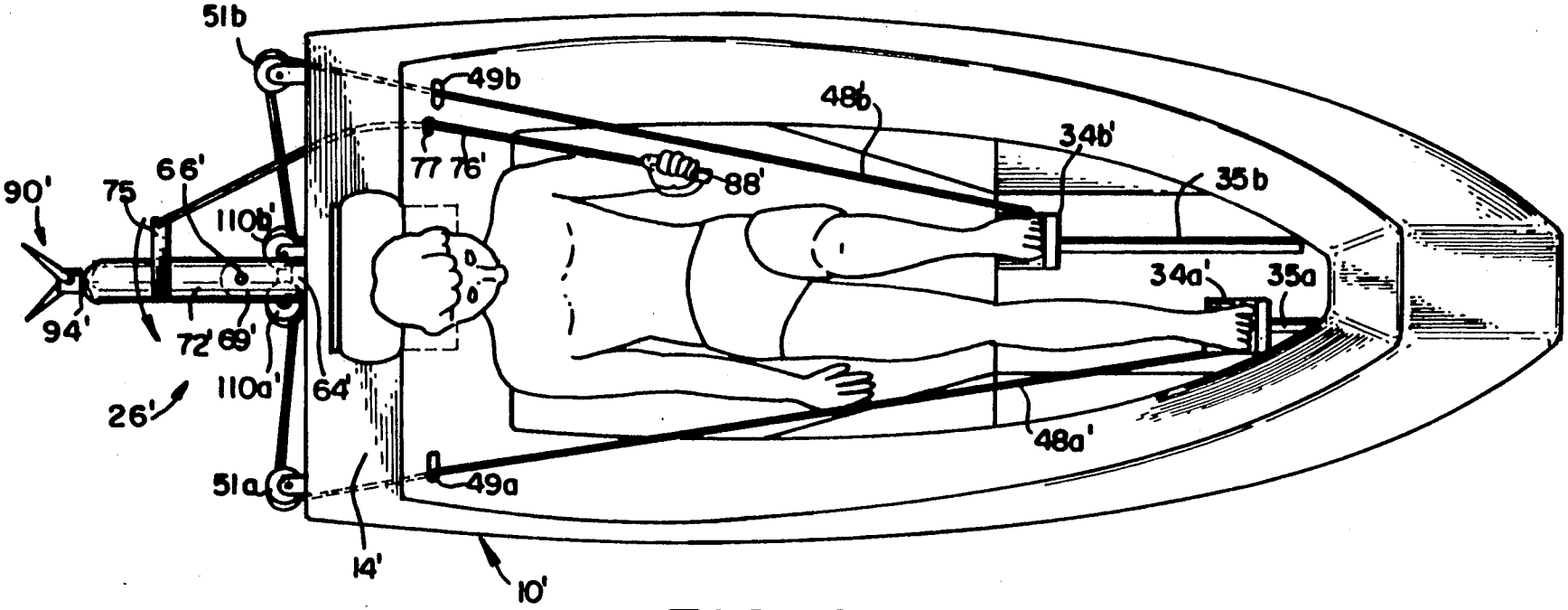
Figure 10:
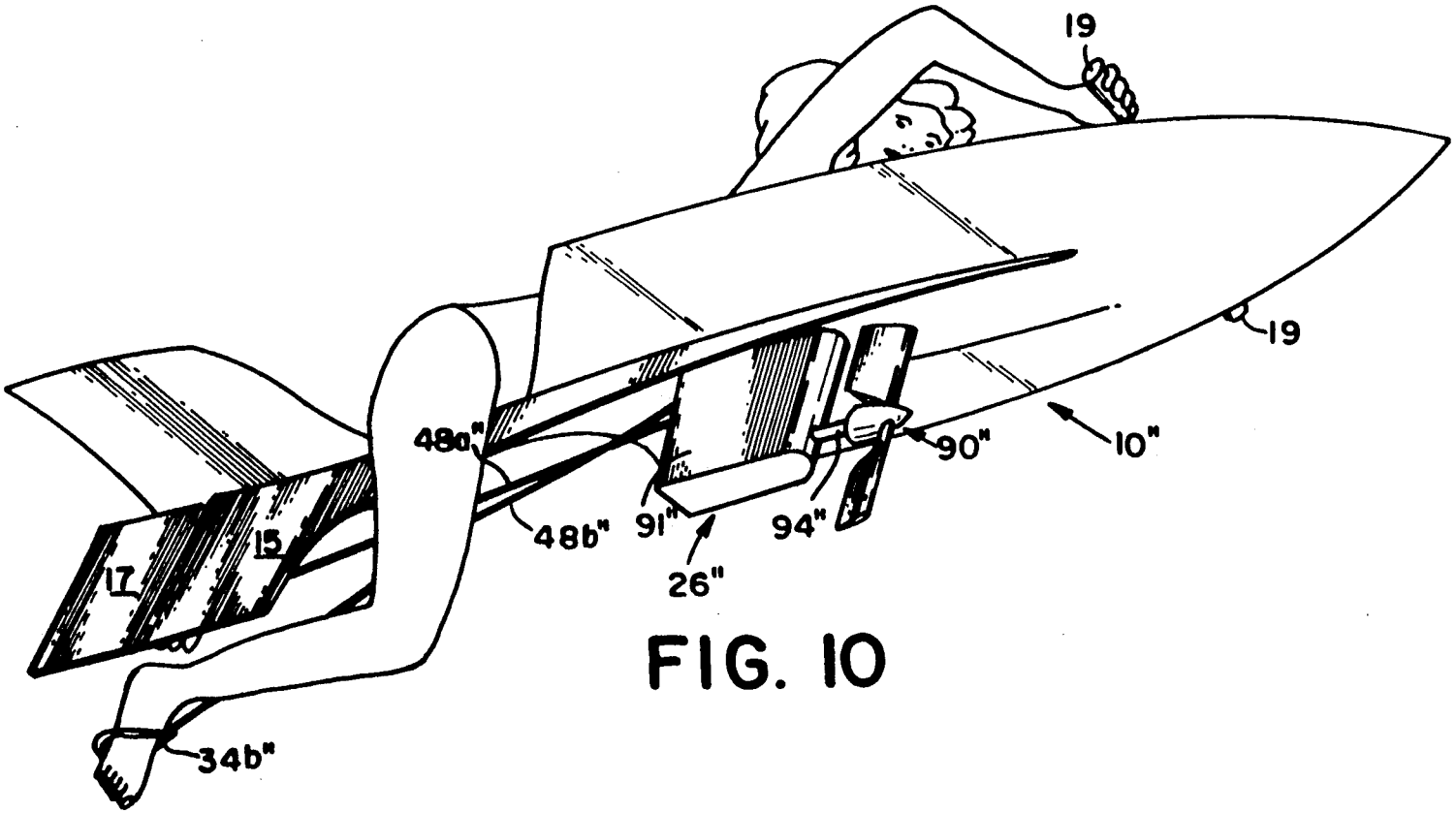
Figure 11:
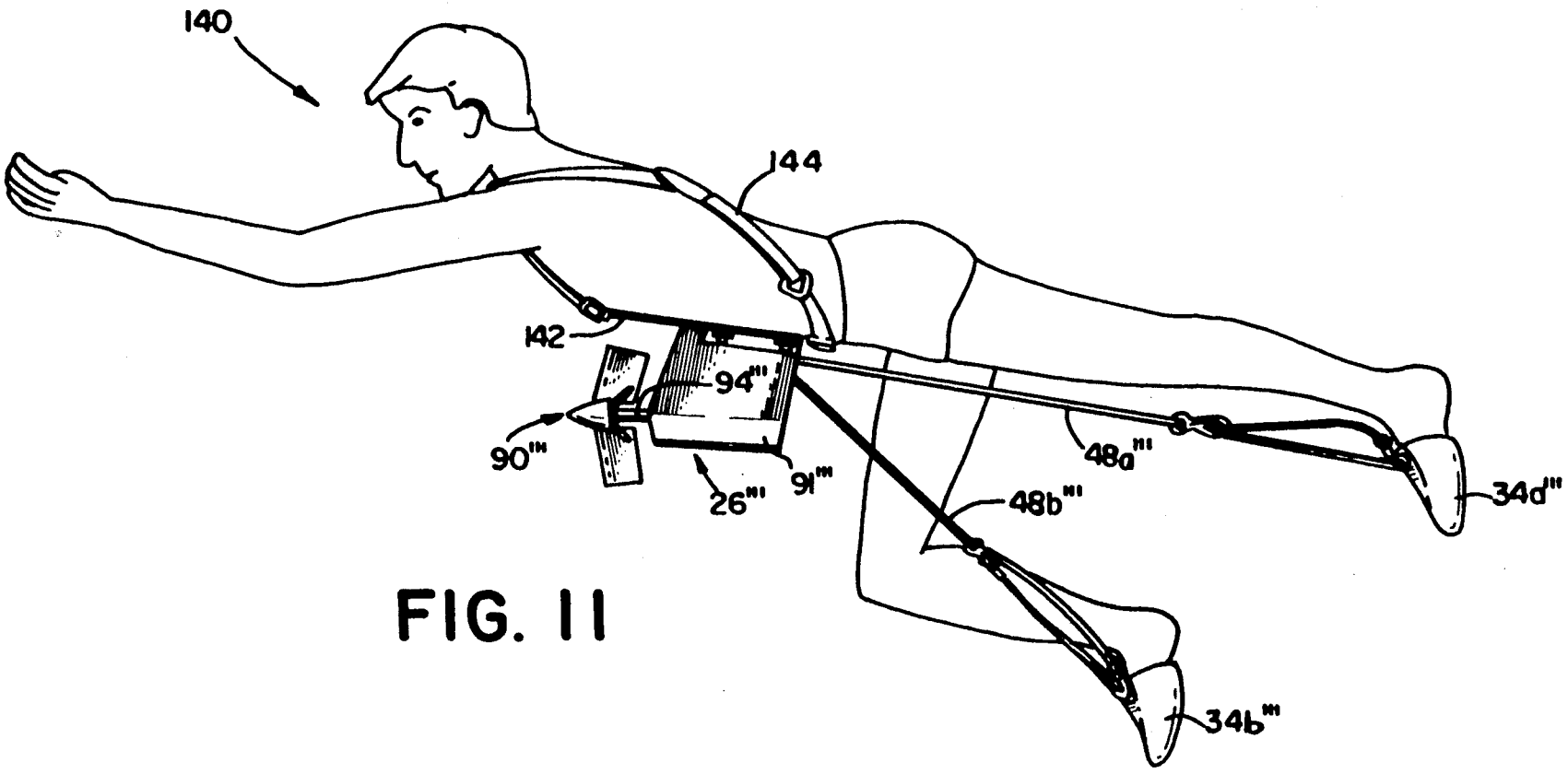

FIG. 3*a* is a sectional view taken along line 3*a*–3*a* in FIG. 3;

FIG. 4 is a plan view from above of the propulsion device of FIG. 3 attached to a boat;

FIG. 4*a* is an exploded view of the propeller seen in FIG. 4 and elsewhere;

FIG. 4*b* is an elevation of the propeller assembled;

FIG. 4*c* is a sectional view taken along lines 4*c*–4*c* of FIG. 4*b*:

FIG. 5 is a front view partially in section of the propulsion device shown in FIGS. 3 and 4:

FIG. 6 is a side elevational view of the propulsion device similar to that of FIG. 3 but showing the propulsion device in a position raised out of the water;

FIG. 7 is a sectional view taken through the bottom of the boat of FIG. 1 of a pedal assembly of the present invention shown in side elevation and somewhat enlarged;

FIG. 8 is a diagrammatic view showing the blades of a modified version of the propeller in operation;

FIG. 9 is a plan view from above showing a modified version of a propulsion device in accordance with the present invention in a different kind of boat environment;

FIG. 10 shows in perspective from beneath still another modified propulsion device for use in connection with still another device in accordance with the present invention;

FIG. 11 is a side elevational view of a further modified propulsion device worn directly by a swimmer without the intervention of a boat or other craft.

Figures 12, 13:
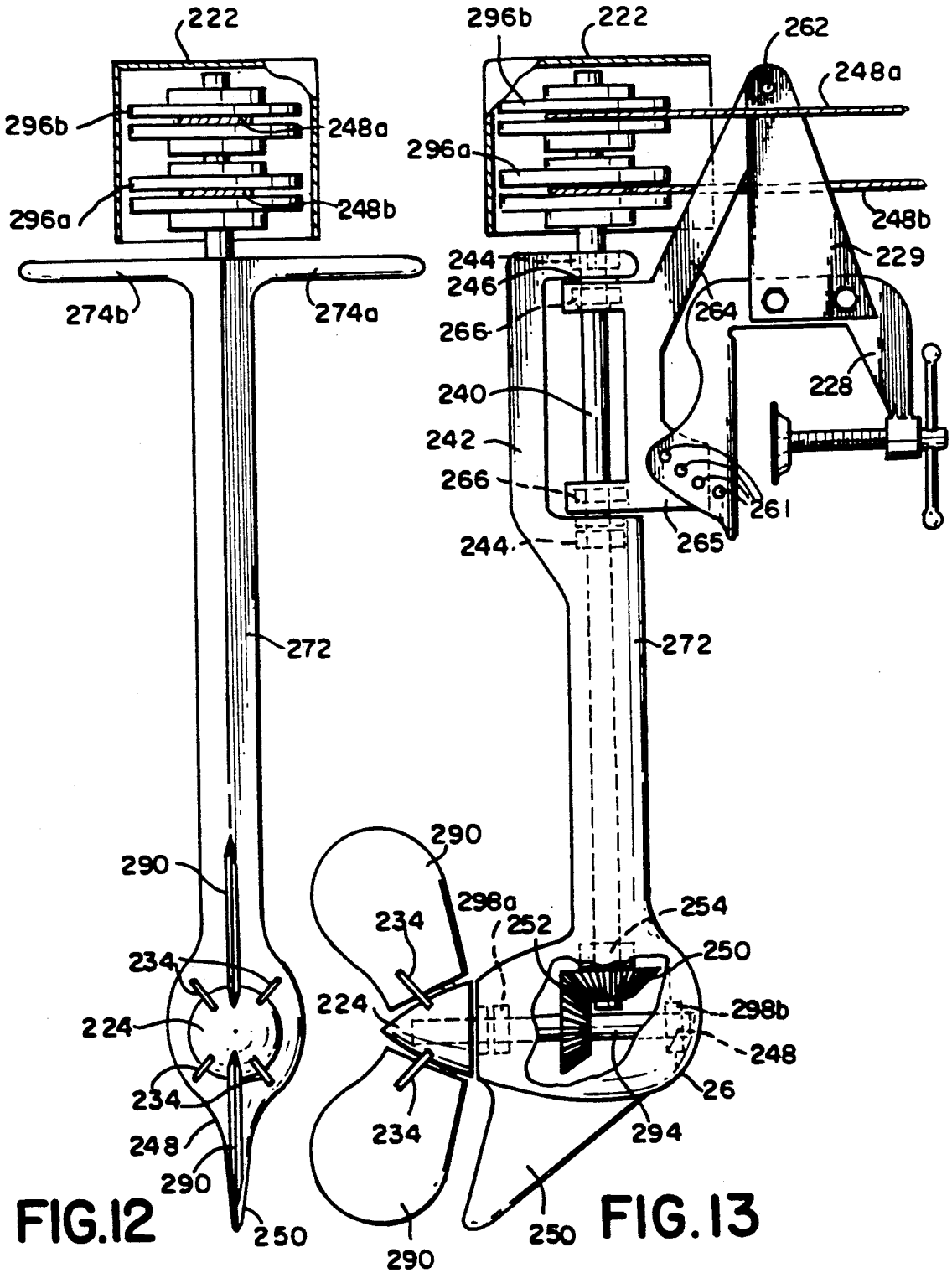

FIG. 12 is a rear elevational view of a modified outboard propulsion device; and FIG. 13 is a side elevational view of the propulsion device shown in FIG. 12.

Referring to FIGS. 1 through 7, there is illustrated a preferred embodiment of the present invention showing a propulsion device in accordance with the present invention in conjunction with a boat of preferred form. In this particular arrangement, as seen particularly in FIGS. 1 and 2, the water craft employed is a boat generally designated 10. This boat has been specifically designed for use with the present invention. The boat employs the principle of the racing shell with a low resistance hydrodynamic form which has been somewhat foreshortened in the drawings. The boat has a pointed prow 12 and a squared transom 14 generally perpendicular to the axis of the boat. The boat is decked over except for cockpit 16 surrounded by a cowling. An operator's chair is provided with a seat 18 at deck level, preferably having a foldable back portion 20. The back portion 20 can be folded about a hinged joint flat against the deck surface at the rear of the seat for transportation, or may be opened against suitable stop means for use as shown. For stability and general safety purposes, the boat is provided with identical outrigger pontoons 22*a* and 22*b* of hydrodynamic form. In some applications, the pontoons may be designed to contact the water constantly, but, in others, they may be supported above the water simply as a stabilizing means should the boat rock. The pontoons are supported by framework, which in preferred embodiments may be as simple as heavy duty aluminum tubing or other lightweight structural members, connecting them to the hull of the boat 10 using U-bolts 84 or the like.

FIG. 3 shows that the man-powered propulsion device of the present invention, generally designated 26, is supported to the transom 14 by conventional clamp means 28 similar to those used on outboard engines.

As seen in FIG. 1, and in detail in FIG. 7, the means for operating the propulsion device is a foot pedal assembly, generally designated 30, and mounted on the bottom 32 of the boat 10. The foot pedals 34*a* and 34*b* are arranged in position to be comfortable for use by the operator sitting on seat 18 and are provided with a range of movement which is also comfortable to someone sitting on seat 18. Seat 18 may be arranged to be movable forward and back on the boat by conventional means (not shown) in order to adjust the position of the user in accordance with his size, the length of his legs, and the like. The pedals 34*a* and 34*b* are rotatably supported by support pin structures 36*a* and 36*b*, similar to those used on bicycles, to levers 38*a* and 38*b*, each of which is supported rotatably on a rod 40*a* and 40*b* respectively. Each of the rods 40*a* and 40*b*, in turn, is supported by brackets 42 on base member 44*a*. Base member 44*a* is removably fixed to anchor plate 44*b* which in turn is fixed to the floor 32 of the boat by adhesives and/or other suitable means. Connected to the levers 38*a* and 38*b* by quick release clamps 46*a* and 46*b* are cables 48*a* and 48*b*. The quick release coupling means preferably connect to stub pins 50*a* and 50*b* or 52*a* and 52*b*, which are provided with heads to hold the coupling means in place. Additional coupling means may be provided to provide greater or lesser mechanical advantage and, hence, lesser or greater action by the propeller.

Figure 2:
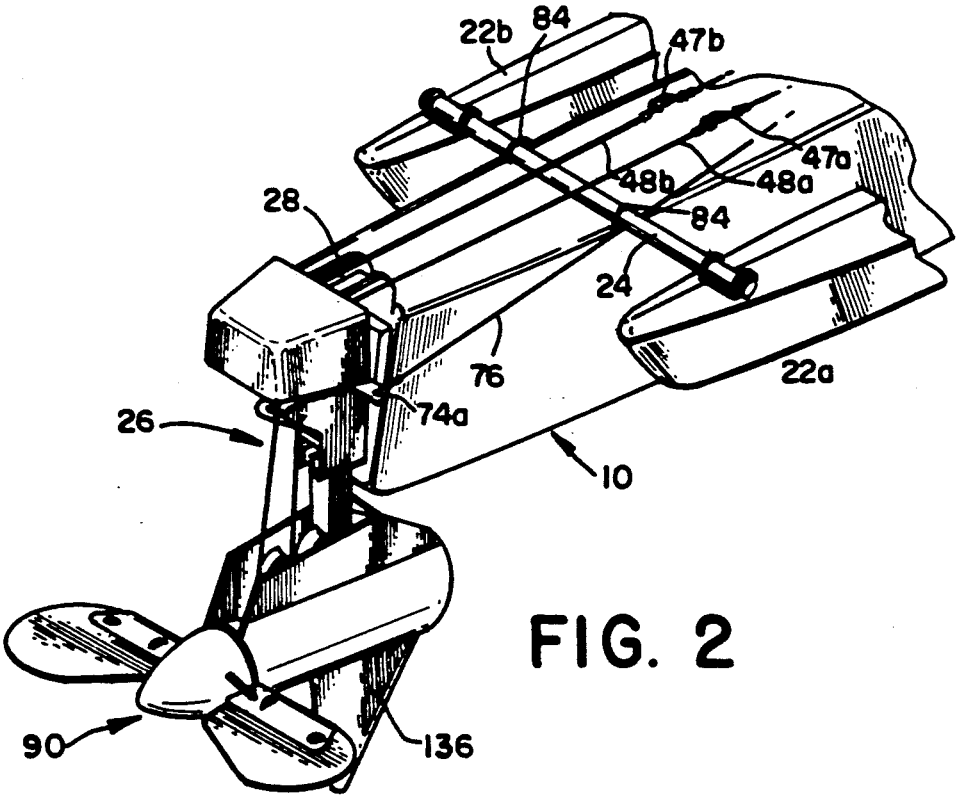
FIG. 2 shows a somewhat enlarged perspective view of the propulsion device attached to the boat from a different angle.

A disconnect junction is preferably provided in cables 48*a* and 48*b* near the propulsion device as shown in FIGS. 1 and 2 wherein each cable 48*a* and 48*b* has a snap hook that engages a coupling link 47*a* and 47*b*, respectively, in the cable portion as seen in FIGS. 3 and 6 attached to the propulsion device. Thus by disconnecting the cables at this junction easy removal of the propulsion device from the boat is accommodated. In addition, pedal levers 38*a* and 38*b* will be pulled down into the cockpit 16 for easy transporting when these cables are pulled back and attached to holes 77*c* and 77*d* provided in the gunwales at the back of the boat. Although not shown in the drawings, it may be necessary or desirable to provide pulleys, or other guide means, to direct the cables beneath the seat to present interference with the seat or other structure.

It is also desirable to have resilient tie means providing a sort of tension spring action tending to act against the cables when the pedals are not in use so as to minimize the opportunity for slack cable problems. As seen in FIGS. 1 and 7, resilient tie means 54*a* and 54*b* are provided with hook attachments at opposite ends which may engage alternative holes 56*a* or 58*a* and 56*b* or 58*b* on the levers 38*a* and 38*b*, respectively, and holes in an anchor bar 60 fixed to the floor 32 of the boat 10 as seen in FIG. 1.

The propulsion device 26 is supported on a lightweight frame structure. Referring to FIG. 3, it will be seen that in this particular application the frame is divided into parts that enable rotatable movement relative to one another. Thus, the propulsion device frame elevating part 64 is connected to the clamp part 28 by pin 62, which is horizontally oriented in the mounted position shown. Clamp part 28 is provided with a series of holes 61 along an arc at a fixed radius from pin 62. Each hole 61 can receive a pin 63 which also passes through a single hole in elevating frame part 64. This arrangement allows the propulsion device to be properly positioned relative to different boat transoms 14 having differing angles to the bottom 32 and the water. It is usually desirable to position the propeller shaft generally horizontally in the water.

Rotatably mounted to the elevating frame part 64 by pin 66 which is vertically oriented in operation is a channel shaped frame part 68. Relative rotation of frame parts 64 and 68 enables the propulsion device to be turned about pin 66 for steering. The channel frame part 68 is provided with parallel flanges 74*a* and 74*b* which embrace frame member 64 and through which passes the pin 66 advantageously in the form of a bolt, thereby rotationally connecting frame parts 64 and 68. The bolt 66 provides a generally vertical axis about which all structure depending from frame part 68 may rotate relative to the frame part 64 and the clamp member 28 and hence the transom of the boat itself. Thus, rotation about this pin provides a means of steering or directing the boat as will appear hereafter. A simple steering mechanism is provided as seen in FIGS. 1, 2 and 4 by employing for the flange 74*a* an angle bracket whose ends extend well beyond the side walls of channel 68 to which the bracket is fixed. The ends of the continuous steering cable 76 are attached to the ends of the steering bracket as seen in FIG. 4. As seen in FIG.

4, the cable is provided with snap hooks 76*a* and 76*b* to permit easy removal of the propulsion device from the boat. The snap hooks of the cable ends may then be attached to the holes 77*a* and 77*b* in the gunwales at the back of the boat to keep the steering cable 76 with the boat and ready for reattachment to the propulsion device.

Cable 76 passes along the opposite sides of the boat to a slide steering handle 88 to which it is attached. Cable 76 is guided around pulleys 80*a* and 80*b*, respectively, to pass beneath seat 18. Pulleys 80*a* and 80*b* are rotatably supported by brackets 82*a* and 82*b* on the sides of the boat. The slide steering handle 88 may be supported and guided within a slot in guide 84 fixed along the gunwale of the boat. The steering handle 88 is located so that the operator of the boat can reach down beside himself with his right hand and by moving the handle 88 forward pull the cable 76 so as to turn the propeller structure counterclockwise about pin 66 as seen in FIG. 4. By contrast, if the handle 88 is pulled back, the pull on the cable is in the opposite direction to cause a rotation clockwise about pin 66. In this way, the axial orientation of the propeller is adjusted and will cause the boat to assume an arcuate course, just as occurs with an outboard motor as the propeller is turned from side to side.

As seen particularly in FIGS. 3 and 6, the frame is subdivided into an above water portion which is intended to provide connection to a boat and an underwater portion which includes a propeller and a propeller shaft and is intended to be below the water. As described, the parts of the frame above the water permit mounting to the boat, adjustment of the position of the propulsion device so as to keep the propeller shaft generally horizontal or parallel to the water surface, and means to permit steering. The above water portion also provides cable guidance structure, which will be discussed hereafter. It is also desirable to keep the structure connecting the upper and lower parts of the propulsion device as simple as possible. In the embodiment disclosed the principal member providing this connection is a tubular member 72 which, in operating position, assumes a generally vertical orientation perpendicular to the water surface. The upper part of the tube 72 is attached by a pair of clamp means 71 between plates 69*a* and 69*b*. Plates 69*a* and 69*b* generally correspond to the form of the channel side walls 68*a* and 68*b* to which they are pivotably connected (see FIG. 4). One piece of each of the pair of clamp means 71 is affixed to plates 69*a* and 69*b* and thus these pieces also serve as structural spacer members. The clamp means 71 are, in effect, opposed blocks with semicircular openings which engage the tube. The blocks are bolted together and the bolts tightened to perform the clamping function as seen in FIG. 6. Similar clamps 73 are provided between the plates 100*a* and 100*b* which, in turn, support the underwater portion of the frame structure from the tube 72. It will be understood by those skilled in the art that simply by loosening the clamp members, a tubular member of different length can be substituted for tubular member 72 to adapt the propulsion device to other boats in which the transom mounts the upper portion of the propulsion device higher or lower out of the water.

As seen in FIGS. 1 to 6, and particularly in FIG. 3, the propulsion device, generally designated 26, is provided with a propeller assembly, generally designated 90. In the preferred embodiment, the propeller assembly basically consists of two blades 92 connected to a propeller shaft 94 through which the propeller is driven. As seen in FIG. 3, the shaft 94 is supported for rotation on the frame by bearing blocks 98*a* and 98*b*, each containing a bearing and seals each side of the bearing to protect them from water. Bearing blocks 98*a* and 98*b* are supported between frame side wall support plates 100*a* and 100*b* which are fixed to the connecting tube 72 by one piece of each of the clamps 73 as discussed above. The bearing blocks 98*a* and 98*b* also provide added cross bracing for the side wall support plates 100*a* and 100*b*. The bottom of the blocks are rounded and provide conforming support for bottom closure 101, which also adds to the rigidity of the overall structure. In addition the bottom closure 101 maintains a close clearance with sheaves 96*a* and 96*b* and thus prevents cables 48*a* and 48*b* from escaping from their respective sheaves when cables are relaxed and not in use. In addition as seen in FIG. 5 each sheave has associated with it, on the side opposite cable entry, a generally wedge shaped piece 103*a* and 103*b* attached to plate 104*a* and 104*b*, respectively, and conforming to the shape of the sheave periphery to aid in keeping the cables in place. The upper aft edges of the support plates 100*a* and 100*b* are also separated, cross braced and rigidized by a post 102.

The driving power for the propeller shaft is provided through the cables 48*a* and 48*b* which are connected to the propeller shaft at sheaves 96*a* and 96*b*, respectively. As best seen in FIG. 4, the cables approach the sheaves 96*a* and 96*b* on opposite sides of the shaft 94. Preferably the sheaves are so narrow in the spacing of their side walls that there is room for only one width of cable between them and the cable then tends to wind on top of itself in a spiral, instead of taking helical or other path with an axial component. As seen in FIG. 3*a*, the end of each cable may be fixed to the shaft 94 by inserting its end into a snug fitting slot in the respective sheaves 96*b* (or 96*a*) parallel to the axis next to the shaft 94. Each sheave is comprised of two halves of which one half has the referenced slot. Also, each sheave half has set screws to fix that respective half to the shaft through a hub portion of the sheave half. In the case of the slotted sheave, one of the set screws intersects the cable end and locks it to the shaft.

In view of the approach of the cables 48*a* and 48*b* from opposite sides of the shaft, as seen in FIG. 5, it will be understood that the shaft rotates in a counterclockwise direction as cable 48*b* is unwound from sheave 96*b* and cable 48*a* winds onto its sheave 96*a*. Conversely, as cable 48*a* is unwound from sheave 96*a*, cable 48*b* will wind onto the sheave 96*b*. The alternate winding and unwinding produced by the foot pedals in this embodiment therefore cause the shaft 94 and the propeller 90 to rotate a limited number of turns in one direction and then reverse to rotate a limited number of turns in the other direction. In operation, shaft 94 will alternate direction of rotation in this manner. Depending on operator preference and conditions of use, the number of turns can be varied from less than one full turn to as many as 4 or more turns around the sheave. For example, in shallow water an obstruction may prevent a full turn of the propeller. However, the propulsion device using alternating partial revolution of the propeller can still propel past the obstruction.

The propeller shaft 94 is preferably terminated in a solid cone 124 which may alternatively be somewhat rounded and which supports pins 126 diametrically opposed in a common diametrical plane and generally normal to the cone surface so that they are raked aft. This positioning of the pins allows the propeller blades 92 to rotate about the pins keeping the bottoms of the blade close spaced to the cone 124 over the short arcs of rotation permitted. The lines defined by the cone are continued by a contoured housing 128 which is fixed to the aft bearing block 98*b*.

Referring now to FIGS. 4, 4*a*, 4*b* and 4*c* and the propeller structure shown, it will be seen that each of the propeller blades 92 is composed of a flexible portion 130 and a more rigid portion 132. The structure of the propeller blade and its assembly can be seen from FIGS. 4*a*, 4*b* and 4*c*. Advantageously the flexible portion 130 is a flexible member which may be molded or machined to provide a solid body of desired flexibility. However, other non-solid structures providing the desired flexing structures may be substituted. While the flexible portion 130 might be composed of rubber, a preferable material might be, for example, polyurathane. Polyurethane has characteristics similar, but superior, to rubber in important respects, i.e., polyurethane will not dry rot. Neither will polyurethane fatigue as easily as rubber. Its flexibility can be controlled by its formulation and is a function of its density and hardness as well as its physical thickness at a particular location. In a preferred application a blade was injected molded of solid 90*a* durometer polyurethane. The shape shown in FIG. 4*a* is a preferred form for a blade for applications like those of FIGS. 1 to 6. The blade has one generally square edge to conform to the cone 124. The blade otherwise has a curved periphery and generally conforms to the shape of metal propeller blades except that it is flat rather than being formed into the normal curved arrangement of propeller blade. The blade thins toward its trailing edge but provides a generally smooth rounded surface at the edge and is itself formed in a smooth curve. A portion of the forward edge provides a recess 131 into which the sheet metal blade edge 132 may be fit. The flexible portion of the blade is advantageously made to conform to and generally fill the space between the folded surfaces of the sheet metal edge 132 which may be composed of stainless steel or other corrosion resistant metal. The folded edge of the sheet metal provides a generally straight line parallel to a slot 135 provided in the recessed area over much of the length of that area. A transverse slot 135*a* is also provided as are various holes to accommodate rivets to secure the sheet metal blade edge 132 to the flexible blade portion 130. After the two pieces are secured together, a washer 127 to hold the pivot pin 126 in place together with a snap ring 127*a* is inserted into the cross slot 135*a* through the opening 132*a* in the blade edge 132. Thereafter the pin 126 is inserted into the slot 135 between the walls of the blade edge through the washer and the snap ring until the snap ring 127*a* engages in the circumferential groove 126*a* to secure the pin in position. The washer projects into the cross slot 135*a* to hold the blade in position against outward motion. The pin itself is secured in the solid cone-shaped hub 124 (FIG. 3). The pin 126 is held in a bore in the hub by set screws which engage circumferential groove 126*b* in preferred embodiments.

As seen in the section FIG. 4*c* the round pin 126 is retained within a generally square hole formed by slot 135 and the sheet metal portion 132 which provides bearing surfaces with contacts along four lines, thereby reducing contact and consequent friction encountered in a cylindrical bore. For the limited rotation of the blade the polyurethane and metal provide adequate bearing surface for the application and water acts as the lubricant. There are two stops per blade provided at equal distances from the diametrical center plane through the pins. The stops are positioned to restrain the blades at a predetermined position but to further accommodate to the flex of the blades under water pressure much like that seen in FIG. 8. The blades are able to slide over the surface of the stops 124 as they assume their functional curvature.

Since, during rotation, water pressure, as indicated by the arrows in FIG. 8, would tend to bend the blade away from the direction of the pressure, a certain amount of rigidity must be inherent in the blade structure. Were it not reinforced, the blade would tend to bend and yield to such water pressure. However, both the pin 126 and the metal blade edge 132 add stiffness to the blade that minimizes the effects which might otherwise tend to cause bending. The blade is designed to rotate about pin 126 to move from one stop to the other as the direction of rotation is changed. The stop acts to hold the edge of the blade near the hub in a predetermined position that allows the blade to flex and slide over the stop to a certain degree to assume a curvature under the pressure of the water which is very close to the curvature of a metal propeller blade and provides the whole propeller assembly with the enhanced effect of a screw thread form, which allows the propeller to drive the boat more efficiently through the water. In its flexing action because of the stiffening of the sheet metal member 132, the leading edge of the blade is limited in its ability to flex and twist about the pin 126. The resilient portion of the blade beyond the sheet metal will readily twist to assume a curvature which may increase as the thickness of the blade decreases both toward its after edge and toward its outer edge. Therefore, the curvature tends to be maximized at the trailing edge of the blade. Of course selection of materials and relative thicknesses of the blade sections will allow variables which can be used to optimize the working contour of the propeller when in use.

As will now be explained hereafter, the design of the propeller 90 is such as to accommodate this type of oscillitory motion and still drive the craft.

It should be noted in passing that a rudder fin 136 seen in FIGS. 1, 2, 3 and 6, and which is attached to the housing portion 101, supported in turn on bearing block 98*a* and 98*b*, aids in steering when the propulsion device is moved from side to side for steering. Fin 136 additionally acts as a bottom deflector and release mechanism which, like similar structure in outboard engines, allows the bottom portion of the frame to rotate about pin 70 as far as into the position shown in FIG. 6 but more commonly into some intermediate position. Of course, the propulsion device can also be manually pulled into the position of FIG. 6, if desired for attention to the cables or necessary minor maintenance while installed on a boat.

As seen in FIGS. 3, 4 and 5, a pair of pulleys 104*a* and 104*b* are supported on parallel shafts 106*a* and 106*b* extending transversly between the side plates 100*a* and 100*b*. Retaining rings are used on the ends of the pulley shafts 106*a* and 106*b* outside of the support plates 100*a* and 100*b* to hold the shafts in position. The pulleys 104*a* and 104*b* are held in their respective positions by retaining rings engaging the respective shafts to feed the cables into sheaves 96*a* and 96*b*, respectively. As seen in FIG. 4, spacer 108*a* surrounding the shaft 106*a* is sufficiently near the periphery of pulley 104*b* to keep cable 48*b* in the pulley. Post 102 performs the same function with pulley 104*a* and cable 48*a*.

As seen in FIGS. 3, 4 and 5 at the top of the frame structure supported above the transom 14 of the boat are other guide pulleys. Channel-shaped frame member 68 supports guide pulleys 110*a* and 110*b* as well as opposed tracking pulleys 112*a* and 112*b* (intentionally omitted for clarity in FIGS. 4 and 5) which keep the cables 48*a* and 48*b* in pulleys 110*a* and 110*b* as the propulsion device is turned relative to the boat in steering. Cables 48*a* and 48*b* pass over pulleys 110*a* and 110*b* thereby changing direction en route to lower pulleys 104*a* and 104*b* preferably in general parallel alignment. Pulleys 110*a* and 110*b* rotate about a common shaft 114 and pulleys 112*a* and 112*b* rotate about a common shaft 116. Both shafts 114 and 116 are supported between the side walls 68*a* and 68*b* of channel-shaped upper frame member 68. Spacers over the shafts 114 and 116 may be provided to keep the pulleys in proper lateral position relative to the side walls 68*a* and 68*b*. The bottom of the channel 68 is cut away at the level of the top of the pulleys 110*a* and 110*b* to permit passage of cables 48*a* and 48*b*. Just below the opening an angle bracket 69 is fixed to the channel 68 to provide support for pulleys 118*a*, 118*b* and 118*c* (see FIGS. 3 and 4). The pulleys rotate about parallel vertically oriented axes with their peripheries close to contact to retain the cables between the pulleys and guide the cables onto pulleys 110*a* and 110*b*. Cable 48*a* is fed through the space between pulleys 118*a* and 118*c* and cable 48*b* is fed through the space between pulleys 118*b* and 118*c*. Pulley 118*c* is preferably on the same axis as is pin 66. The arrangement of these pulleys allows proper alignment to be maintained even though the propulsion device is rotated about pin 66.

Covering the upper pulleys and support structure to which it is affixed is a cowling 122. The cowling may be contoured for pleasing appearance, but the spaces where cables enter from the boat and leave for the drive shaft must be left open.

FIG. 8 is a reverse oriented propeller structure from that shown in FIGS. 1-6 for a craft like that shown in FIG. 10, for example. That is, the orientation of the propulsion device, with the propeller forward of the drive, is reversed from that shown in the device of FIGS. 1-6. The structure of FIG. 8 also shows foreshortened blades having a square outer edge, as opposed to the curved outer edges shown in FIGS. 1-6. However, the propeller is of a type appropriate for the propulsion devices of FIGS. 10 and 11. In the FIG. 8 arrangement, the supporting pin is also raked in a reversed direction relative to the propeller shaft so that the bottom of the blade cannot follow the contour of the cone as it rotates, which dictates a different shape for the bottom of the blade as well.

Since the propeller arrangement of FIG. 8 may be used with the various craft shown in FIGS. 10 and 11, reference to the drawing will illustrate how such a propeller may be employed. In these two FIGS., the corresponding structural members are given corresponding numbers but with the addition of double primes thereto. Thus, shaft 94" functions the same and provides oscillatory motion to the propeller. Cone hub 124" provides support for pins 126" and, in turn, the flexible blades 92". Cone 124" also supports stop members or the edge restricters 134". It will be appreciated that extending from opposite sides of the cone 124" are similar pins 134" in similar orientation and in the same diametrical plane. In this embodiment the pins 126" are raked backward from the pins shown in FIG. 4, for example. However, blades 92*a*" and 92*b*" rotate about their respective pins 126" on each side of the conical hub 124" until they contact a stop 134". At this point, as the blades are rotated the pressure of the water causes the blades to assume curvature as shown in FIG. 8, better adapting them to the "screw" function of a normal propeller. Each blade will reach a point of stability while sliding on each of the associated stops 134" and retain that position until rotation is reversed. Upon reversal of the propeller shaft the blades will rotate about the pin 126 against the other stop 134" and flex in the opposite direction. In each case the blades provide a proper screw configuration for that particular rotation. The ability to assume a free form shape that naturally is most efficient in performing the screw function is one of the desirable features of the present invention.

It will be understood that the under water portion of the structure and propellers 92 of FIGS. 1-6 function in a similar tut opposite way since the direction of propulsion by the total propulsion device in the axial direction is opposed to that of FIG. 8. However, an important advantage of the structure of the invention is the interchangeability of drive systems for various types of craft making minor structural change. Here the substitution of a new cone hub and blade configuration on the opposite end of the propeller shaft and substitution of a different plastic deflector is needed.

Referring now to FIGS. 9 and 10, two modified structures using a modified propulsion device in accordance with the present invention is shown. FIG. 9 might be a styrofoam boat 10' of somewhat broader beam than the boat of FIGS. 1 and 2, allowing the user to recline within the largely open cockpit of the boat. Foot pedals 34*a*' and 34*b*' may be blocks guided to run along tracks 35*a* and 35*b*, for example. The cables 48*a*' and 48*b*' are attached at the foot pedals 34*a*' and 34*b*', respectively, and in the form shown, pass through eyelets 49*a* and 49*b* and around pulleys 51*a* and 51*b* which are supported by brackets on the boat to direct the cables downwardly. Pulleys 100*a*' and 110*b*' are supported on a frame structure generally designated 26'. A part 64' of frame 26' may be permanently fixed to or molded into the transom 14' of boat 10'. Frame part 64', in turn, is rotatably connected by a pin 66' to frame part 72' supporting a rotatable propeller shaft. The internal structure of frame part 72' corresponds to the underwater structure of FIG. 3, for example. The steering of the boat is accomplished simply by having a flexible rod 76' which can be moved back and forth through an opening 77 to be maneuvered by handle 88' Rod 76' acts upon an arm 75 attached to frame member 72' for changing position of frame part 72' rotationally about pin 66' and thus the direction of the propeller 90'.

FIG. 10 shows yet another modified craft 10", which might be described as a modified surfboard. The craft 10" has a keel 15 to which a rudder 17 is rotatably attached to move about a vertical axis. Steering may be provided by a handle 19 of T-shape mounted atop the craft 10" and provided with suitable connection lines or linkage mechanism to rotate the rudder relative to the keel to provide steering.

In such an embodiment as FIG. 10, the propulsion device 26" becomes extremely simple with a propeller 90" of the type previously described and specifically of the type shown in FIG. 8. The propeller is mounted on a shaft 94" extending into a housing 91" with a rounded edge forward and square edge aft, including an opening through which cables 48b'' and 48a'' pass. In this case, the cables are connected to stirrups 34b'' and 34a'' (not shown) which function to drive the shaft 94'' by reciprocating motion. In such a construction, the cables preferably enter over pairs of pulleys (not shown) but identical to pulleys 104a and 104b of FIGS. 3, 4 and 5 and with such minimal clearance between the tops of these pulleys and the bottom of the craft as to keep the cables in position and avoid escape from the pulley. These pulleys are placed at different positions forward and aft to correspond to the position of sheaves on the shaft 94''. Such an arrangement is intended to provide the ultimate simplicity in a motor drive.

A similar system is shown in FIG. 11 wherein a propulsion device 26''' is directly strapped onto a swimmer using a harness 144. Again, a housing 91''' containing elements similar to that of the structure described in FIG. 10 is provided and the cables 48a''' and 48b''' are terminated in stirrups 34a''' and 34b'''. The propulsion device 26''' is attached to a swimmer 140 by use of a frame in the form of a supporting plate 142. The supporting plate may be flat or contoured to an individual wearer 140 and held onto the swimmer by a harness 144. The mechanism is much the same as in the previously described devices with appropriate guiding pulleys and operational sheaves supported on shaft 94''' to drive the propeller assembly 90'''. The action is provided through the cables 48a''' and 48b''' through the action of stirrups or foot holders 34a''' and 34b''' into which the swimmer is able to insert his feet. A reciprocating action of the feet moves the propeller 90''' while at the same time the swimmer, as desired, can use his hands. It would be anticipated that in most instances the swimmer would wear some sort of flotation device as well and such flotation device could be built into the harness structure or could be kept separate therefrom.

Referring to FIG. 3, only limited changes are needed to produce the propulsion device of FIGS. 9, 10 and 11. The upper part of the propulsion device is eliminated by removing the post 72 by releasing the clamps. The plastic parts 123 and 128 and the fin 136 are removed. The device is reversed so that the propeller hub points forward instead of aft. The blades reversed on the prop hub as in the devices of FIGS. 10 and 11, and the blades and stop configuration of FIG. 8 are substituted. In view of the reversal of direction, suitable flow covers are also needed to replace cover 128 for streamlining. This flexibility provides a major advantage to the propulsion device of the present invention.

FIGS. 12 and 13 show another variation of the propulsion device of the present invention which is also capable of being mounted on the back of a boat much as an outboard motor is or more specifically in an arrangement corresponding to that of FIG. 3. In this case, however, a separate drive shaft 240 is provided and gear coupled to the propeller shaft 294.

Referring to FIG. 13 it will be seen that a clamp part 228 is provided similar to the type of such device as used on outboard motors. The clamp is provided with a bracket 229 which is rotatably coupled to bracket part 264 by pin 262. In this case, a series of holes 261 provided in the clamp enable a stop pin to be inserted at different positions to oppose a stop shoulder 265a on portion 265 of the bracket. Thus the bracket 264 doubles in enabling adjustment of the propulsion device so that the propeller shaft is generally horizontal when mounted on the boat and also does not restrict movement away from the pin stop to allow the propeller 290 to clear an obstruction encountered by fin 250 for example. The support bracket 246 is a frame portion which provides spaced apart bearing support flanges for bearings 266 which support the drive shaft 240. The drive shaft is also supported within housing 272 which provides a bearing 244 at the end of the housing. Another bearing 244 is provided on an extension arm 242 which bypasses the flanges on bracket 264 and allows the positioning of the bearings 244 outside those bearings 266 on the bracket. A bushing 246 is placed between the respective upper flanges to minimize frictional effect between the two in the course of any rotation. The housing extension 242 also provides lateral extension steering arms 274a and 274b to which steering cables are attached for steering in a fashion similar to that shown in the embodiment of FIGS. 1–7. The drive shaft 240 projects above the upper bearing 244 so that sheaves 296a and 296b may be affixed in that elevated location. In this position at the top of the drive shaft it is relatively easy for the cables 248a and 248b to be connected to the shaft via the sheaves 296a and 296b, respectively. In this way the structure of this embodiment cuts down considerably on the amount of pulleys and direction changing devices that are required. Also, since in this embodiment the drive shaft is the axis of rotation of the steering mechanism, no additional precautions need to be taken to keep the cables 248a and 248b lined up with the direction changing means. As steering occurs, the sheaves maintain the same position with slight angular adjustment which produces little or no effect on the cables. If desired, a cover or cowling 222 may be provided over the end the drive shaft 240 and the sheaves. Although means of support is not shown, the cowling is supported from bracket 264 by support means under cable 248b.

In the embodiment of FIGS. 12 and 13, the propeller shaft 294 is supported within an enlarged chamber of the housing 272 by bearings 298a and 298b. Bearing 298a may be also positioned next to a seal to close off the housing since the coupling between the drive shaft 240 and the propeller shaft 294 is in the form of bevel gears which require protection from foreign elements. The lower end of the drive shaft is supported in a bearing 254, preferably immediately next to gear 250. Gears 250 and 252 are provided a gear box by the enlarged portion of the housing. The generally conical propeller hub 224 and the propeller blades 290 have a similar configuration and arrangement to those shown in FIGS. 3 and 4, 4a, 4b and 4c. Stop means 234 are similarly positioned and serve a similar function.

It will be apparent to those skilled in the art that FIGS. 12 and 13 provide a somewhat simpler configuration. On the other hand, the flexibility of the device is not as great. For example, the lower part of the device cannot be used without the upper nor can the device be adjusted by substituting different tubular members 72 of various lengths to accommodate particular needs of particular boats.

Various other types of shaft means may be employed, including separate drive shafts for each of the sheaves connected independently, or cooperatively, to the propeller shaft.

From the above, it will be seen that a great many variations in the present invention are possible from the simplest device which requires no steering to far more complex devices which are, in essence, analogous to an outboard engine on a small boat. Various modifications have been suggested, but it will be clear to those skilled in the art that many other modifications are possible and many other applications are possible as well. All such modifications and additional applications within the scope of the claims are intended to be within the scope and spirit of the present invention.

I claim:

1. A man powered propulsion device for propelling a lightweight craft comprising:

a frame for mounting the propulsion device on said craft;

shaft means rotatably supported on the frame including at least a propeller shaft;

propeller means on said propeller shaft, including at least one blade rotatably supported relative to the shaft for rotation about an axis having a major radial component;

stop means supported relative to the shaft limiting movement of each blade in each direction from a plane through the propeller shaft;

a pair of cables coupled to the shaft means to turn the propeller shaft and positioned to be wrapped around the shaft means so that as one wraps the other unwraps from around the shaft means so as to drive the propeller shaft alternately in opposite directions as the respective cables are unwrapped;

sheave means on the shaft means for each of the cables to contain and direct the cables as they are alternately wrapped and unwrapped around the shaft; and means affording connection to limbs of a man to permit man powering and affixed to the cables to enable the cables to be pulled alternately to drive the shaft means by applying force to unwrap one cable wrapped around the shaft means, whereby, as the cable which is wrapped around the shaft means is unwrapped, the other cable is wrapped around the shaft means to thereby impart an oscillator motion to the propeller means.

2. The propulsion device of claim 1 in which the propeller means includes at least two blades symmetrically arranged around the shaft and rotatably supported in corresponding orientation relative to the shaft.

3. The propulsion device of claim 2 in which the blades of the propeller means are made of flexible material sufficiently rigid to be held by the stop means but sufficiently yielding to accommodate to the pressure of water as the propeller means is rotated so as to assume the proper configuration for a screw in each attitude of the blade to drive the craft in the proper direction generally in the direction of the propeller shaft.

4. The propulsion device of claim 1 in which the shaft means consists simply of a propeller shaft.

5. The propulsion device of claim 4 in which cable direction changing means are provided to guide cables to opposite sides of the propeller shaft.

6. The propulsion device of claim 5 in which each direction changing means is a pulley rotatably supported on the frame.

7. A craft employing the propulsion device of claim 4 in which the craft is a floatation board and the frame is fixed to the board and the cables are brought out of the propulsion device beneath the water.

8. The craft and propulsion device of claim 7 in which limb coupling devices on the ends of the cables are arranged beneath the board so that the cables throughout their length are underwater during use.

9. The craft and propulsion device of claim 7 in which the frame of the propulsion device is fixed to the bottom of the board and the cables pass over direction changing means and are directed aft of the propulsion device to stirrup devices for engagement by the feet of a man powering the propulsion device beneath the water.

10. The craft and propulsion device of claim 9 in which the propeller means is positioned on the propeller shaft forward of the propulsion device and arranged to pull the propulsion device.

11. The craft and propulsion device of claim 7 in which a rudder is pivotally supported on the board beneath the board and means for steering the rudder unrelated to the propulsion device and extending above the board is provided.

12. The craft and propulsion device of claim 11 in which the cables pass over direction changing means and are connected to foot stirrups and hand control means is used to manipulate the rudder.

13. The propulsion device of claim 1 in which a boat supports the man powered propulsion device essentially out of the water and at least the propeller shaft is arranged to be supported beneath the water line from the boat with cables passing upwardly out of the water and into the boat through direction changing means.

14. The boat and propulsion device of claim 13 in which the propulsion device is supported from the boat so that its shaft means and propeller means are able to be turned relative to the boat about an axis generally perpendicular to the propeller shaft and steering means is provided to move the propulsion device about its rotatable support to steer the boat.

15. The boat and propulsion device of claim 14 in which cables are brought into the boat above the water line.

16. The boat and propulsion device of claim 15 in which the cables are terminated in pedal means which are movably secured to the boat.

17. The boat and propulsion device of claim 16 in which the pedal means are slide means in guides secured to the bottom of the boat.

18. The boat and propulsion device of claim 16 in which the pedal means include foot pedals rotatably secured to levers on pivotable supports fixed to the bottom of the boat and provided with resilient means tending to keep the levers spring loaded into a preferred position.

19. The boat and propulsion device of claim 13 in which cable directing pulleys have axes generally parallel to one another to provide the direction changing means at the underwater level of the propeller shaft positioned to direct the cables onto the respective sheave means and also at an above water upper level.

20. The propulsion device of claim 13 in which the propulsion device is separable from and releasably attachable to a boat.

21. The propulsion device of claim 20 in which the releasable attachment to a boat is provided by clamp means attached to the frame which permits attachment without the use of tools.

22. The propulsion device of claim 21 in which the clamp means has a horizontal pin rotatably attaching it to part of the frame and adjustable means permitting selectable angular positions of the frame part to the clamp means and means to fix the frame relative to the clamp means together to enable the propulsion device to be maintained generally in a position in which the propeller shaft is essentially horizontal when the propulsion device is attached to a boat.

23. The propulsion device of claim 22 in which at least one of the clamp means and the frame part has a plurality of holes alignable with at least one hole in the other whereby upon alignment of holes on the clamp means and frame part a pin can be put in place to hold the clamp means and frame relative to one another in that selected position.

24. The propulsion device of claim 20 in which a vertical pin connection is made between parts of the frame, whereby the part carrying the propeller means can be rotated about said pin to steer a boat to which the other part is attached and means attached to the rotatable part of the frame of the propulsion device enabling the propulsion device to be rotated about the pin and positioned at will for steering the boat.

25. The propulsion device of claim 24 in which direction changing pulleys are provided to direct the cables from above the water down to the sheave means and input guide means are provided to guide the cables onto the direction changing pulleys.

26. The propulsion device of claim 25 in which the guide means are pulleys rotatably supported on the frame with their axes parallel to one another and their peripheries sufficiently adjacent to keep the cables in the pulleys.

27. The propulsion device of claim 26 in which the input guide pulleys have their axes in a common plane and the axis of a center pulley of the guide pulleys is aligned with the vertical pin connection between parts of the frame.

28. The propulsion device of claim 24 in which steering means is provided by a pair of lateral extending steering arms on the frame which turns the propulsion device about the vertical pin in response to forces on the respective arms.

29. The propulsion device of claim 28 in combination with a boat in which the steering means is provided by arms on the frame extending laterally, each side of the frame providing rotation about the vertical pin and cable means extending into the boat to steering means is attached to each of the laterally extending steering arms whereby pulling on a particular cable means attachment will steer the boat one way and pulling on the other will steer the boat in the other direction.

30. The combination of the propulsion device of claim 29 and boat in which the steering cable means is attached at its ends to the respective steering arms whereby the cable means may be attached to the boat when not in use permitting the propulsion device to be removed from the boat.

31. The propulsion device and boat combination of claim 29 in which the steering cable means is one continuous cable in a loop within the boat directed over direction changing means fixed to the boat and means attached to the cable facilitating movement of the cable relative to the boat in order to turn the propulsion device.

32. The propulsion device and boat combination of claim 31 in which the cable means is movable by a slide means attached to the boat which can be manipulated by hand to pull on different steering arms as the slide means is moved in opposite directions.

33. The propulsion device and boat combination of claim 32 in which the cable is fed along a path along the respective sides of the boat as defined by pulleys providing direction means at a cable cross over across the boat and is provided with releasable clips at the end for attachment to the propulsion device.

34. The propulsion device and boat combination of claim 33 in which the boat is provided with a guide attached to the boat and a slide steering handle which is attached to the continuous cable for steering.

35. The propulsion device of claim 1 in which pulley means to direct the cables onto each of said sheave means at opposite sides of the shaft are provided by pulleys having parallel shafts supported on the frame, but staggered so as to direct the respective cables into the respective sheave means, the frame includes a lower propeller unit and upper direction changing attachment and manipulation structure and an intermediate frame member extending between the upper structure and propeller unit which can be adjusted in length in accordance with the height above water of the boat to which the unit is to be affixed.

36. The propulsion device of claim 35 in which the pulleys are oriented to have a common horizontal axis and are provided as direction changing means on the upper part of the device in position to align the cables with the pulleys directing the cables into the sheave means.

37. The propulsion device of claim 36 in which three pulleys having parallel axes, in a plane normal to the general direction of the cables, guide the cables between adjacent pulleys and over the direction changing pulleys.

38. The propulsion device of claim 1 in which the shaft means includes a drive shaft coupled to the propeller shaft to drive the propeller shaft at an angle to the drive shaft, including bearing means supported on the frame, the frame including a portion connectable to a boat above the water supporting the drive shaft and the sheave means is located on the drive shaft whereby the cables may directly approach the sheave means.

39. The propulsion device of claim 38 in which the coupling between the drive and propeller shafts is meshing beveled gears.

40. The propulsion device of claim 39 in which the gears are housed within a housing providing at least one seal below the water line to prevent entry of water into the gear housing.

41. The propulsion device of claim 40 in which the housing is extended above the water line surrounding the drive shaft and a seal is provided above the water line.

42. The propulsion device of claim 40 in which the frame includes a housing surrounding bevel gears and a tubular extension surrounding the drive shaft and an extension from the tubular extension spaced away from the shaft and terminating in an upper bearing supporting portion for the shaft and a clamp structure which is capable of being clamped to a boat providing bearing means support also around the shaft in the region intermediate to the upper bearing and the tubular extension, which enables the frame of the propulsion device to be rotated relative to the clamp structure about the drive shaft for steering purposes.

43. The propulsion device of claim 42 in which the bearings of the frame bracket the support for connection to a boat and a pair of steering arms are provided on the housing generally transverse to the drive shaft and in a position allowing cable means to be attached to the respective arms so that pulling on the respective arms will steer the boat in opposite directions.

44. The propulsion device of claim 43 in which the support consists of a clamp device to clamp the propulsion device to the boat rotatably connected by a horizontal pin to a mount, the mount and the clamp further providing a position adjustment device to hold the mount in proper orientation during operation so that the propeller shaft of the propulsion device is essentially horizontally disposed within the water.

45. The propulsion device of claim 44 in which the position adjusting device consists simply of a movable stop on the clamp against which the mount rests having several positions so that the mounted portion of the position adjusting device is free to be moved by forces acting below the water such as the bottom to move the propeller means out of danger.

46. A boat suitable for use with a man powered propulsion device comprising a hull generally in the form of a lightweight shell having a bottom and side walls converging to a bow and in a squared transom on which a propulsion device may be mounted, a seat for the operator mounted on the boat and pedal means fixed to the boat in position to be operated by the feet of a man sitting in the seat including at least two pedals relatively movable to each other rotatably supported on levers which are in turn rotatably supported on the boat by rotatable supports, each of the rotatable supports being transverse to the bottom of the boat and generally parallel to one another, connection means for cables from the propulsion device to the respective levers, and resilient means connected between the levers and a point forward in the boat to bias the pedals toward the bow of the boat.

47. The boat of claim 46 in which the pedals are supported on a plate which is removably attached to the boat.

48. The boat of claim 46 in which the cables include cables engaging the propulsion device and connecting cables which are removably attached to the cables of the propulsion device so that they can be detached when not in use.

49. A boat suitable for use with a man powered propulsion device comprising a hull generally in the form of a lightweight shell having a bottom and side walls converging to a bow and a squared transom on which a propulsion device may be mounted, a seat for the operator mounted on the boat placed high in the boat adjacent the gunwales and pedal means fixed to the boat in position to be operated by the feet of a man sitting in the seat including at least two pedals relatively movable to each other, means for connection of cables from the propulsion device to the respective pedal means and outrigger pontoons are supported from the boat to provided added stability.

50. The boat of claim 49 in which the seat is provided with a back rest which is foldable against the deck for compactness and opens against stop means for use in operating the boat.

51. A boat suitable for use with a man powered propulsion device comprising a hull generally in the form of a lightweight shell having a bottom and side walls converging to a bow and a squared transom on which a propulsion device may be mounted, a seat for the operator mounted on the boat and pedal means fixed to the boat in position to be operated by the feet of a man sitting in the seat including at least two pedals relatively movable to each other, means for connection of cables from the propulsion device to the respective pedal means, and steering means is provided in the form of a continuous cable connectable to steering arms on the propulsion device crossing the boat by virtue of direction changing means beneath the seat and attached to manual steering means.

52. The boat of claim 51 in which the steering means has a handle attached to the steering cable to move the steering cable one direction or the other along its path to steer the boat in one direction or the other which handle is supported relative to the boat by longitudinal slide means positioned along side the seat whereby the operator can conveniently grip the steering handle and move it forward or aft to steer the boat one way or another.

53. A man powered propulsion device for propelling a swimmer;

a frame for mounting the propulsion device on said swimmer;

shaft means rotatably supported on the frame including at least a propeller shaft;

propeller means on said propeller shaft, including at least one blade rotatably supported relative to the shaft for rotation about an axis having a major radial component;

stop means supported relative to the shaft limiting movement of each blade in each direction from a plane through the propeller shaft;

a pair of cables coupled to the shaft means to turn the propeller shaft and positioned to be wrapped around the shaft means so that as one wraps the other unwraps from around the shaft means so as to drive the propeller shaft alternately in opposite directions as the respective cables are unwrapped;

sheave means on the shaft means for each of the cables to contain and direct the cables as they are alternately wrapped and unwrapped around the shaft; and means affording connection of the respective cables to limbs of the swimmer to permit man powering and affixed to enable the cables to be pulled alternately to drive the shaft means by applying force to unwrap one cable wrapped around the shaft means, whereby, as the cable which is wrapped around the shaft means is unwrapped, the other cable is wrapped around the shaft means to thereby impart an oscillatory motion to the propeller means.

54. The propulsion device of claim 53 in which a harness is affixed to the frame of the propulsion device to hold the propulsion device on the swimmer.

55. The propulsion device of claim 53 in which direction changing means to guide the cables are provided by pulleys rotatably supported on the frame and each cable is terminated in stirrup-like devices whereby the propulsion device may be operated by the feet of the man powering the device.

56. The propulsion device of claim 53 in which the propeller means is at the forward end of the propulsion device and oriented to pull the propulsion device through the water behind the propeller means.

* * * * *

UNITED STATES PATENT AND TRADEMARK OFFICE

CERTIFICATE OF CORRECTION

PATENT NO. : 5,090,928

DATED : February 25, 1992

INVENTOR(S) : Joseph A. Rybczyk

It is certified that error appears in the above-identified patent and that said Letters Patent is hereby corrected as shown below:

Column 10, line 42, "100a'" should read --110a'--.

Signed and Sealed this

Thirteenth Day of July, 1993

*Attest:*

Michael K. Kirk

MICHAEL K. KIRK

*Attesting Officer*

*Acting Commissioner of Patents and Trademarks*